US007779803B2

(12) United States Patent
Yamamoto et al.

(10) Patent No.: US 7,779,803 B2
(45) Date of Patent: Aug. 24, 2010

(54) ROCKER ARM INSTALLED MODULE

(75) Inventors: Naoyuki Yamamoto, Aichi (JP); Masahide Sakurai, Aichi (JP); Tomoki Miyoshi, Aichi (JP); Naoki Hiramatsu, Aichi (JP)

(73) Assignee: Otics Corporation, Nishio (JP)

( * ) Notice: Subject to any disclaimer, the term of this patent is extended or adjusted under 35 U.S.C. 154(b) by 444 days.

(21) Appl. No.: 11/948,598

(22) Filed: Nov. 30, 2007

(65) Prior Publication Data

US 2008/0127923 A1 Jun. 5, 2008

(30) Foreign Application Priority Data

Dec. 5, 2006 (JP) ..... 2006-328601

(51) Int. Cl.
*F01L 1/18* (2006.01)

(52) U.S. Cl. ..... 123/90.39; 123/90.27; 123/90.44; 123/195 C; 74/569

(58) Field of Classification Search ..... 123/90.27, 123/90.31, 90.39, 90.44, 193.3, 193.5, 195 C, 123/198 E, 198 F; 29/888.2; 74/559, 567, 74/569

See application file for complete search history.

(56) References Cited

U.S. PATENT DOCUMENTS 6,550,432 B2 * 4/2003 Takahashi et al. ..... 123/90.15

FOREIGN PATENT DOCUMENTS

JP 61-279710 12/1986

* cited by examiner

*Primary Examiner*—Ching Chang
(74) *Attorney, Agent, or Firm*—Oblon, Spivak, McClelland, Maier & Neustadt, L.L.P.

(57) ABSTRACT

A rocker arm installed module 1 is constructed by installing the cam shaft 3, the rocker arm 4 and the pivot 5 to the housing 2. The housing 2 is provided with a drop-off preventing means 21 for supporting and preventing the rocker arm 4, which is disposed on the pivot 5, from dropping off. The rocker arm installed module 1 is constructed by disposing the rocker arm 4 among the cam 31 of the cam shaft 3, the pivot 5 and the drop-off preventing means 21 in the housing 2 to form a module, the module being configured to be disposed in a concave portion 61 of the cylinder head 6 while preventing the rocker arm 4 from dropping off.

4 Claims, 8 Drawing Sheets

ROCKER ARM INSTALLED MODULE

CROSS-REFERENCES TO RELATED APPLICATIONS

The present application claims priority under 35 U.S.C. §119 to Japanese Application No. 2006-328601, filed Dec. 5, 2006, entitled "ROCKER ARM INSTALLED MODULE". The contents of this application are incorporated herein by reference in their entirety.

BACKGROUND OF THE INVENTION

1. Field of the Invention

The present invention relates to a rocker arm installed module which is used in an engine valve opening and closing mechanism and in which a pivot, a rocker arm and a cam shaft are installed in a housing.

2. Description of the Related Art

A valve opening and closing mechanism for use in a reciprocal engine of a vehicle or the like is constructed so as to execute suction and exhaust of air in combustion of engine by opening and closing an engine valve for suction and exhaust of air by receiving a rotation of a cam in a cam shaft and rocking a rocker arm. In an overhead cam (OHC) type engine, an end of the rocker arm is in engagement with the top of a pivot which forms a rocking support point while the other end thereof is in engagement with the top of a stem front end portion of the engine valve. In the rocker arm, a roller supported between a pair of supporting walls is kept in contact with the cam located thereabove. When the engine is actuated, the rocker arm rocks such that it is sandwiched among the cam, the pivot and the engine valve so as to open and close the engine valve.

In the above-described conventional valve opening and closing mechanism, the pivot, the rocker arm and the cam shaft are installed directly onto a cylinder head of the engine. Thus, these components have never been formed into a module by installing them separately from the cylinder head up to now. Further, if no engine valve exists below the rocker arm when the rocker arm is installed, it might drop off because its posture is not stabilized.

In the meantime, patent document 1 has disclosed an internal combustion engine in which a guide wall capable of receiving the bottom face of a push rod when the cam follower is removed is formed on the cylinder head. However, even in the patent document 1, any device for formation into a module or any device for preventing the rocker arm from dropping off has not been achieved like the above-described conventional valve opening and closing mechanism.

Patent document 1: JP61-279710 Unexamined Patent Publication (Kokai)

SUMMARY OF THE INVENTION

The present invention has been achieved in views of the above-described conventional problems and intends to provide a rocker arm installed module which can be formed into a module by installing a cam shaft, a rocker arm and a pivot onto a housing while preventing the rocker arm from dropping off.

According to a first aspect of the present invention, there is provided a rocker arm installed module comprising:

a housing disposed in a cylinder head in which engine valves are arranged slidably;

a cam shaft supported rotatably relative to the housing;

a rocker arm for opening and closing the engine valve by receiving a rotation of a cam provided on the cam shaft and rocking; and a pivot which is fixed to the housing and supports an end of the rocker arm slidably while forming a rocking support point of the rocker arm, wherein the housing includes a drop-off preventing means for supporting the rocker arm not to drop off from the pivot, and the drop-off preventing means is disposed at a lower position than a rocking range when the rocker arm is actuated, and the rocker arm is disposed among the cam of the cam shaft, the pivot and the drop-off preventing means in the housing to form a module, the module being configured to be disposed in the cylinder head while the rocker arm is prevented from dropping off.

In the rocker arm installed module of the present invention, the cam shaft, the rocker arm and the pivot are installed to the housing. By disposing the housing in this installed state on the cylinder head, the stem front end portion of the engine valve disposed slidably on the cylinder head can be engaged with the rocker arm in the housing. Consequently, the valve opening and closing mechanism of an engine can be formed.

The rocker arm installed module can be installed separately from the cylinder head and can be carried individually. The housing is provided with the drop-off preventing means. When installing the cam shaft, the rocker arm and the pivot to the housing, the rocker arm is disposed among the cam of the cam shaft, the pivot and the drop-off preventing means. Consequently, the rocker arm is supported by the pivot and the drop-off preventing means from downward, so that it is prevented from dropping off upward by the cam. Thus, the rocker arm installed module can prevent the rocker arm from dropping off of the housing.

The rocker arm installed module can be disposed in the cylinder head in which the engine valves are disposed slidably while preventing the rocker arm from dropping off. Consequently, the rocker arm installed module can be installed to the cylinder head easily.

The drop-off preventing means in the housing is provided at a lower position than the rocking range when the rocker arm is actuated. As a result, when the rocker arm and the stem front end portion of the engine valve are engaged with each other, the drop-off preventing means can be prevented from being an obstacle to the rocking motion of the rocker arm.

Accordingly, the rocker arm installed module of the present invention enables the cam shaft, the rocker arm and the pivot to be installed to the housing while preventing the rocker arm from dropping off, to form a module.

According to a second aspect of the present invention, there is provided a rocker arm installed module comprising:

a housing disposed in a cylinder head in which engine valves are arranged slidably;

a cam shaft supported rotatably relative to the housing;

a rocker arm for opening and closing the engine valve by receiving a rotation of a cam provided on the cam shaft and rocking; and a pivot which is fixed to the housing and support an end of the rocker arm slidably while forming a rocking support point of the rocker arm, wherein the housing includes an inserted drop-off preventing means for supporting the rocker arm not to drop off from the pivot, the inserted drop-off preventing means is disposed in a rocking range when the rocker arm is actuated, and the rocker arm is disposed among the cam of the cam shaft, the pivot and the inserted drop-off preventing means in the housing to form a module, the module being configured to be disposed in the cylinder head while the rocker arm is prevented from dropping off and after the module is disposed in the cylinder head, the inserted drop-off preventing means is removed from the housing.

The rocker arm installed module of the second aspect of the present invention is also so constructed by installing the cam shaft, the rocker arm and the pivot to the housing. Then, by disposing the housing in this installed state to the cylinder head, the stem front end portion of the engine valve which is disposed slidably on the cylinder head can be engaged with the rocker arm in the housing, so as to form a valve opening and closing mechanism for an engine.

The rocker arm installed module can be installed separately from the cylinder head and can be carried individually. Further, the housing includes the inserted drop-off preventing means. When installing the cam shaft, the rocker arm and the pivot to the housing, the rocker arm is disposed among the cam of the cam shaft, the pivot and the inserted drop-off preventing means. Consequently, the rocker arm is supported from downward by the inserted drop-off preventing means, so that it is prevented from dropping off upward. Thus, the rocker arm installed module can prevent the rocker arm from dropping off of the housing.

Further, the rocker arm installed module can be disposed on the cylinder head in which the engine valves are disposed slidably while preventing the rocker arm from dropping off. Consequently, the rocker arm installed module can be installed to the cylinder head easily.

The inserted drop-off preventing means in the housing is provided within the rocking range when the rocker arm is actuated and can be inserted into/removed from the housing. Then, when the rocker arm installed module is disposed on the cylinder head, and the rocker arm and the stem front end portion of the engine valves are engaged with each other, the inserted drop-off preventing means can be removed from the housing. Consequently, the inserted drop-off preventing means can be prevented from being an obstacle to the rocking motion of the rocker arm.

Accordingly the rocker arm installed module of the present invention enables the cam shaft, the rocker arm and the pivot to be installed to the housing while preventing the rocker arm from dropping off so as to form a module.

DESCRIPTION OF THE PREFERRED EMBODIMENTS

The preferred embodiments of the above-described first and second embodiments will be described. In the first embodiment, it is preferable that a plurality of the pivots are fixed and a plurality of the rocker arms are disposed corresponding to the quantity of the pivots in the housing, and the drop-off preventing means include a plurality of drop-off preventing projections formed in the housing corresponding to arrangement positions of a plurality of rocker arms.

In this case, a rocker arm installed module can be formed in which a plurality of the rocker arms and pivots are installed onto the housing while preventing each rocker arm from dropping off with each drop-off preventing projection.

In the second aspect of the present invention, it is preferable that the cam shaft includes a plurality of the cams, a plurality of the rocker arms are disposed in parallel along the axial direction of the cam shaft corresponding to the quantity of the cams, and the inserted drop-off preventing means include an inserted drop-off preventing pin which is provided in the housing in parallel to the cam shaft and capable of preventing a plurality of the rocker arms from dropping off.

In this case, a plurality of the rocker arms can be prevented from dropping off by the same inserted drop-off preventing pins, thereby reducing the quantity of the inserted drop-off preventing pins. In this case also, the rocker arm installed module can be formed by installing a plurality of the rocker arms and pivots to the housing while preventing a plurality of the rocker arms from dropping off with the inserted drop-off preventing pins.

EMBODIMENTS

Hereinafter, the embodiment of the rocker arm installed module of the present invention will be described with reference to the accompanying drawings.

First Embodiment

Figure 1:
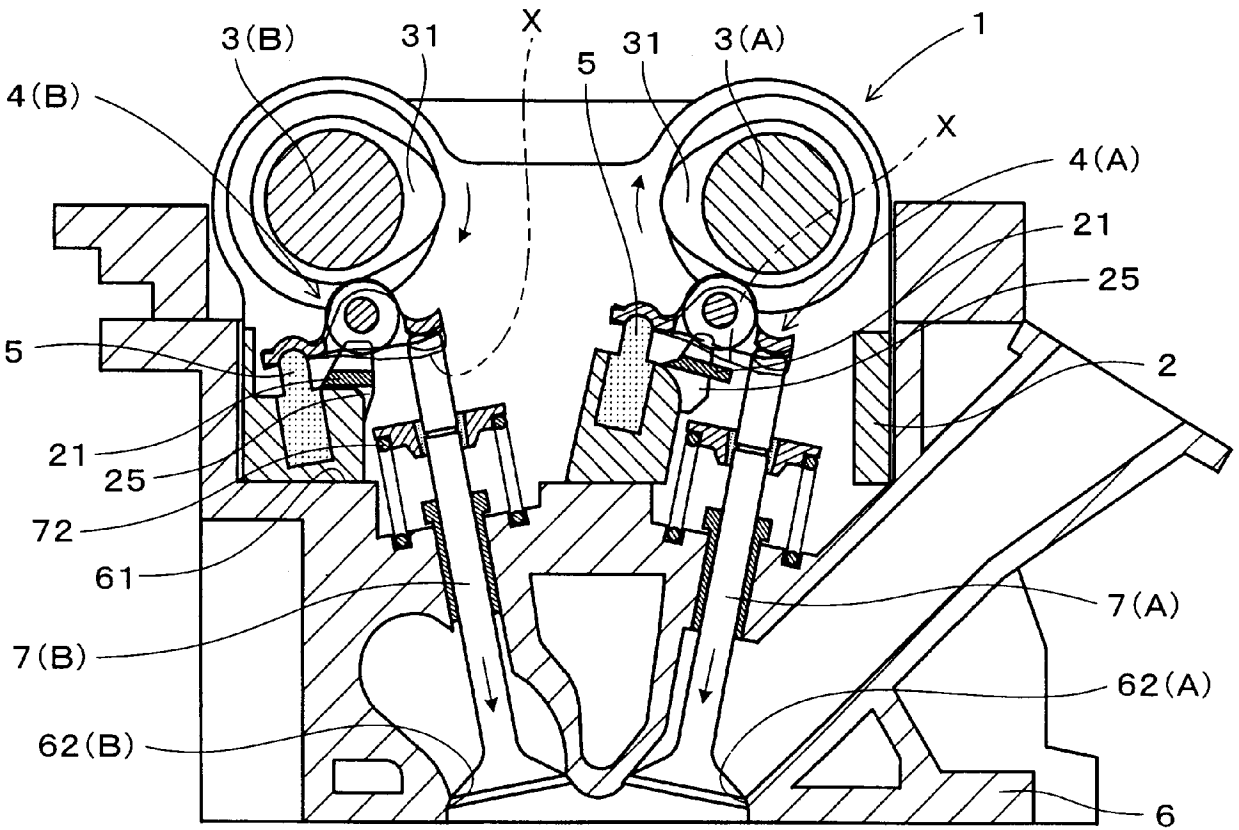
FIG. 1 is a sectional explanatory diagram showing a condition in which a rocker arm installed module is disposed within a concave portion in the cylinder head, according to the first embodiment.

In the rocker arm installed module 1 of this embodiment, as shown in FIG. 1, a cam shaft 3, a rocker arm 4 and a pivot 5 are installed onto a housing 2. The housing 2 is molded into a shape which allows an engine valve 7 to be disposed within a concave portion 61 of the cylinder head 6 such that it is slidable (see FIGS. 3, 4). The cam shaft 3 is supported rotatably relative to the housing 2. The rocker arm 4 is constructed to open/close the engine valve 7 when it rocks by receiving a rotation of a cam 31 provided on the cam shaft 3. The pivot 5 is fixed to the housing 2, supporting an end of the rocker arm 4 such that it can slide, whereby forming a rocking support point of the rocker arm 4.

Figure 2:
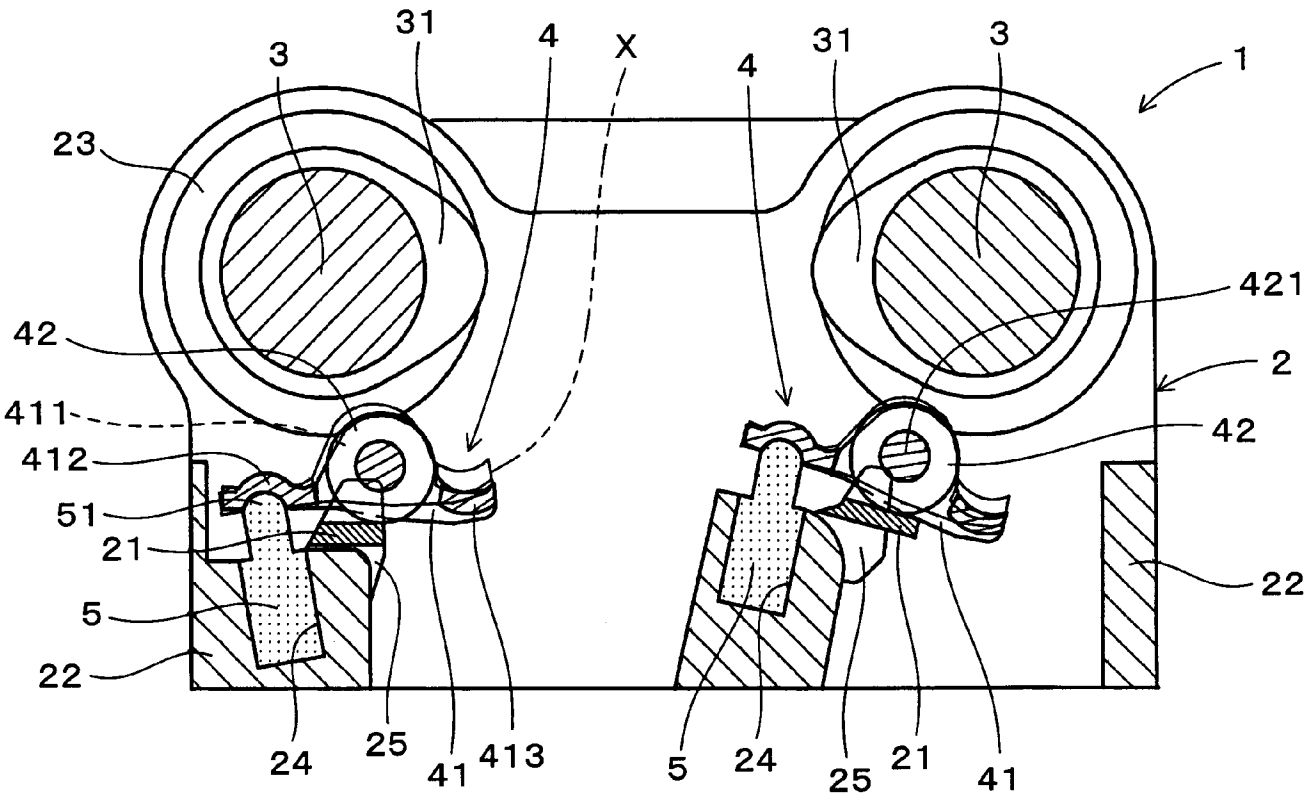
FIG. 2 is a sectional explanatory diagram showing the rocker arm installed module according to the first embodiment.

As shown in FIG. 2, the housing 2 is provided with a drop-off preventing means 21 for supporting the rocker arm 4 an end of which is disposed on the pivot 5, from dropping off, and the drop-off preventing means 21 is disposed at a lower position relative to a rocking range X when the rocker arm 4 is actuated. Then, as shown in the same Figure, the rocker arm installed module 1 is constructed into a module by disposing the rocker arm 4 among the cam 31 on the cam shaft 3, the pivot 5 and the drop-off preventing means 21 in the housing 2, as shown in the FIG. 1, 3, so that the rocker arm installed module 1 is disposed in the concave portion 61 of the cylinder head 6 in a state where the rocker arm 4 is prevented from dropping off.

Hereinafter, the rocker arm installed module 1 of this embodiment will be described in detail with reference to FIGS. 1-5.

The rocker arm installed module 1 of this example is used for the cylinder head 6 of an overhead cam (OHC) type engine.

Figure 4:
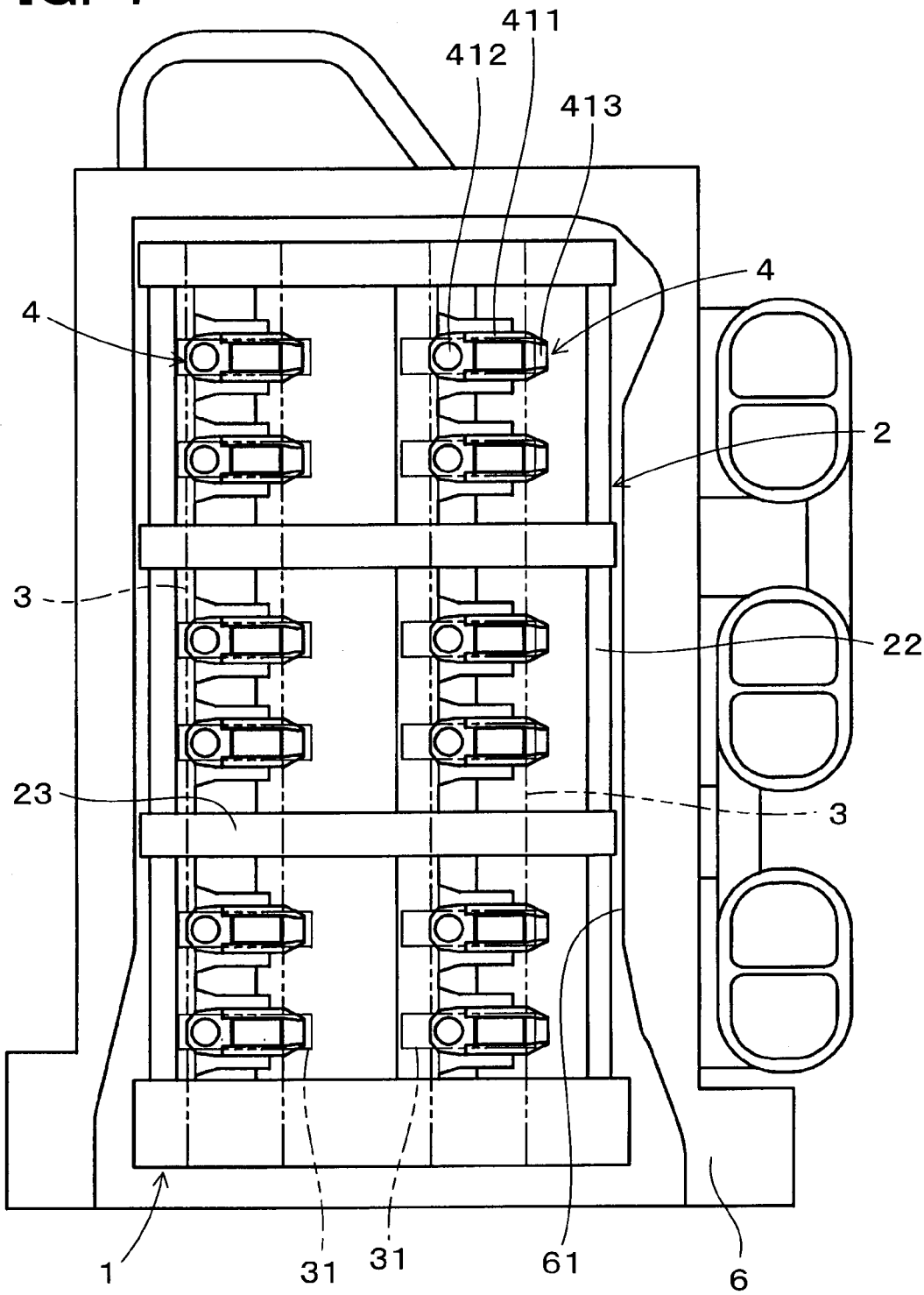
FIG. 4 is a plan explanatory diagram showing a condition in which the rocker arm installed module is disposed within the concave portion of the cylinder head, according to the first embodiment.

As shown in FIG. 1, in the cylinder head 6, engine valves 7 which can slide to open/close a suction/exhaust port 62 (suction port 62A or exhaust port 62B) of the engine are disposed in the cylinder head 6. The cylinder head 6 of this embodiment forms a 4-valve, 3-cylinder engine and as shown in FIG. 4, two engine valves 7A as a suction valve and two engine valves 7B as an exhaust valve are disposed in each cylinder as shown in FIG. 4.

Each engine valve 7 is urged in a direction of closing the suction/exhaust port 62 by a coil spring 72.

As shown in FIGS. 1, 2, the housing 2 is so constructed that a plurality of the pivots 5 are fixed and a plurality of the rocker arms 4 are disposed corresponding to the quantity of the pivots 5. In the housing 2, the cam shaft 3, the rocker arm 4 and the pivot 5 are disposed on each of the suction side and the exhaust side.

As the cam shaft 3, a suction side cam shaft 3A which rocks the rocker arm 4 for opening and closing the suction valve 7A disposed on the suction port 62A and an exhaust side cam shaft 3B which rocks the rocker arm 4 for opening and closing the exhaust valve 7B disposed on the exhaust port 62B are provided. Then, the suction side cam shaft 3A is provided with a plurality of the cams 31 corresponding to the quantity of the suction side rocker arms 4A and the exhaust side cam shaft 3B is provided with a plurality of the cams 31 corresponding to the quantity of the exhaust side rocker arms 4B.

As shown in FIG. 2, in the housing 2, a pivot holding portion 24 for fixing the pivot 5 and a bearing portion 23 for supporting the cam shaft 3 rotatably are formed. As shown in FIG. 4, the bearing portions 23 are formed at a plurality of positions so as to support each cam shaft 3 at a plurality of positions in the axial direction. A pair of frame portions 22 opposing each other in its frame configuration are connected through their tops by the bearing portions 23 so as to form the housing 2.

Figure 5:
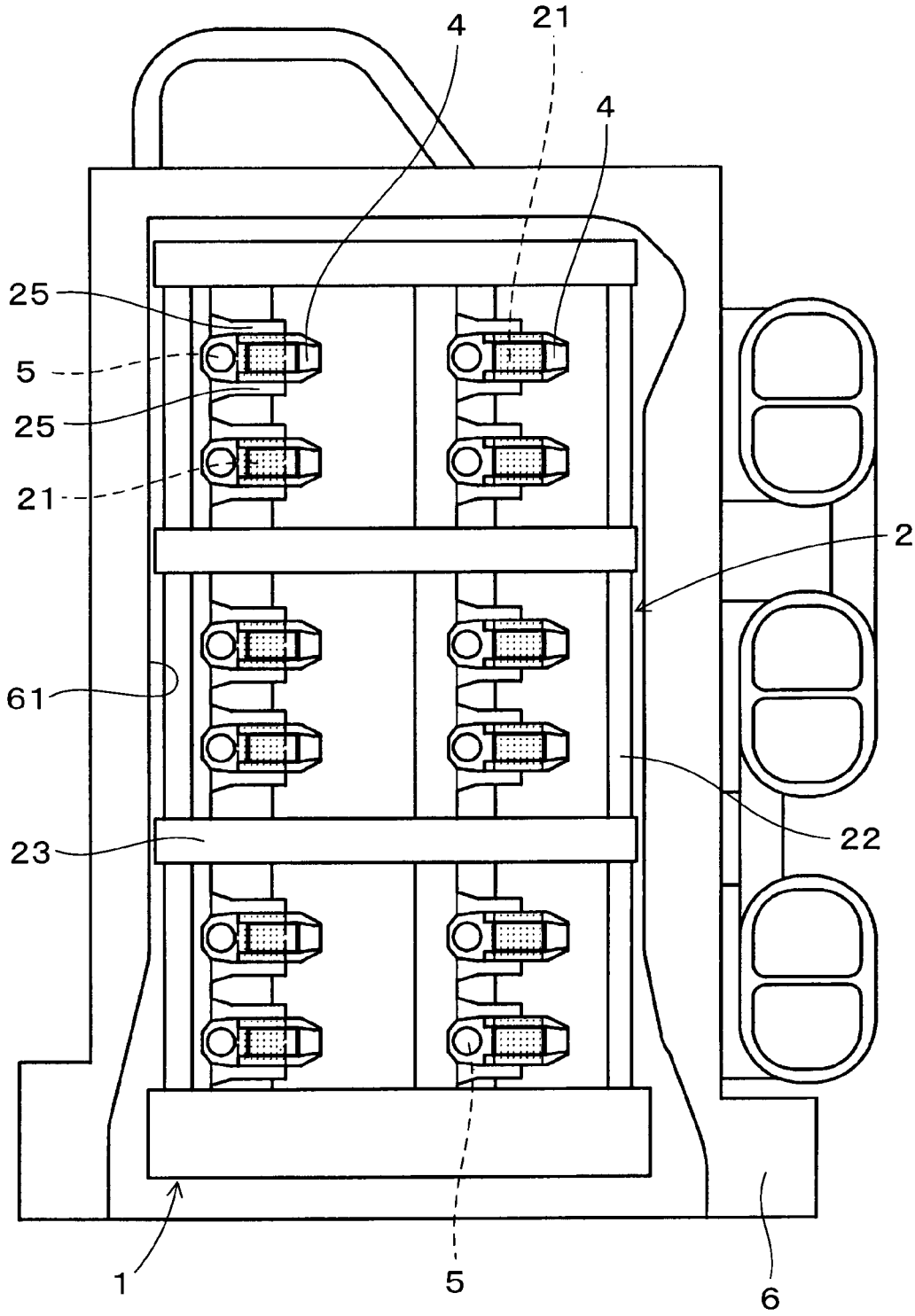
FIG. 5 is a plan explanatory diagram showing a condition in which the rocker arm installed module is disposed within the concave portion of the cylinder head, according to the first embodiment.

As shown in FIGS. 2, 5, in the housing 2, a rocking guide 25 for guiding the rocker arm 4 in the lateral direction (direction perpendicular to the rocking direction connecting an end in engagement with the pivot 5 with the other end in engagement with a stem front end portion 71 of the engine valve 7) is formed corresponding to a place in which each rocker arm 4 is disposed.

As shown in FIG. 4, a plurality of the rocker arms 4 and pivots 5 are disposed in parallel in the housing 2 along the axial direction of the cam shaft 3 corresponding to the quantity of the cams 31 provided on the cam shaft 3. As shown in FIG. 2, a front end portion 51 of the pivot 5 is formed in a semi-spherical convex shape and an end of the rocker arm 4 is formed in a semi-spherical concave shape in engagement the semi-spherical convex front end portion 51 of the pivot 5 so as to cover it.

As shown in FIGS. 2, 5, the drop-off preventing means 21 of this embodiment is formed projecting from the housing 2 and the drop-off preventing projections 21 are formed at a plurality of positions of the housing 2 corresponding to arrangement positions of a plurality of rocker arms 4. The drop-off preventing projection 21 of this embodiment is formed on the bottom portion of the rocking guide 25.

In the meantime, the drop-off preventing projection 21 may be formed to connect the rocking guides 25 or may be formed by projecting from each rocking guide 25 to a downward position of the rocker arm 4.

FIGS. 4, 5 show a condition in which the rocker arm installed module 1 is disposed within the concave portion 61 of the cylinder head 6 as seen from above. Further, FIG. 4 shows arrangement condition of the cam shaft 3 and the cam 31 and FIG. 5 shows an arrangement of the drop-off preventing projection 21.

As shown in FIG. 2, the rocker arm 4 of this embodiment includes an arm main body 41 and a roller 42 disposed on this arm main body 41 via a supporting pin 421. The arm main body 41 has a pair of supporting walls 411 formed opposing each other by bending a flat plate and the pair of the supporting walls 411 are connected with a first connecting portion 412 formed at an end and a second connecting portion 413 formed at the other end. The first connecting portion 412 is configured to engage the pivot 5 and the second connecting portion 413 is configured to engage the stem front end portion 71 of the engine valve 7 (see FIG. 3).

As shown in the same Figure, the outer peripheral face of the roller 42 disposed on the arm main body 41 makes contact with the outer peripheral face of the cam 31 of the cam shaft 3.

As shown in FIG. 1, the rocker arm 4 drives the roller 42 with a rotation of the cam 31 and rocks vertically around the pivot 5 so as to open/close the engine valve 7.

Figure 3:
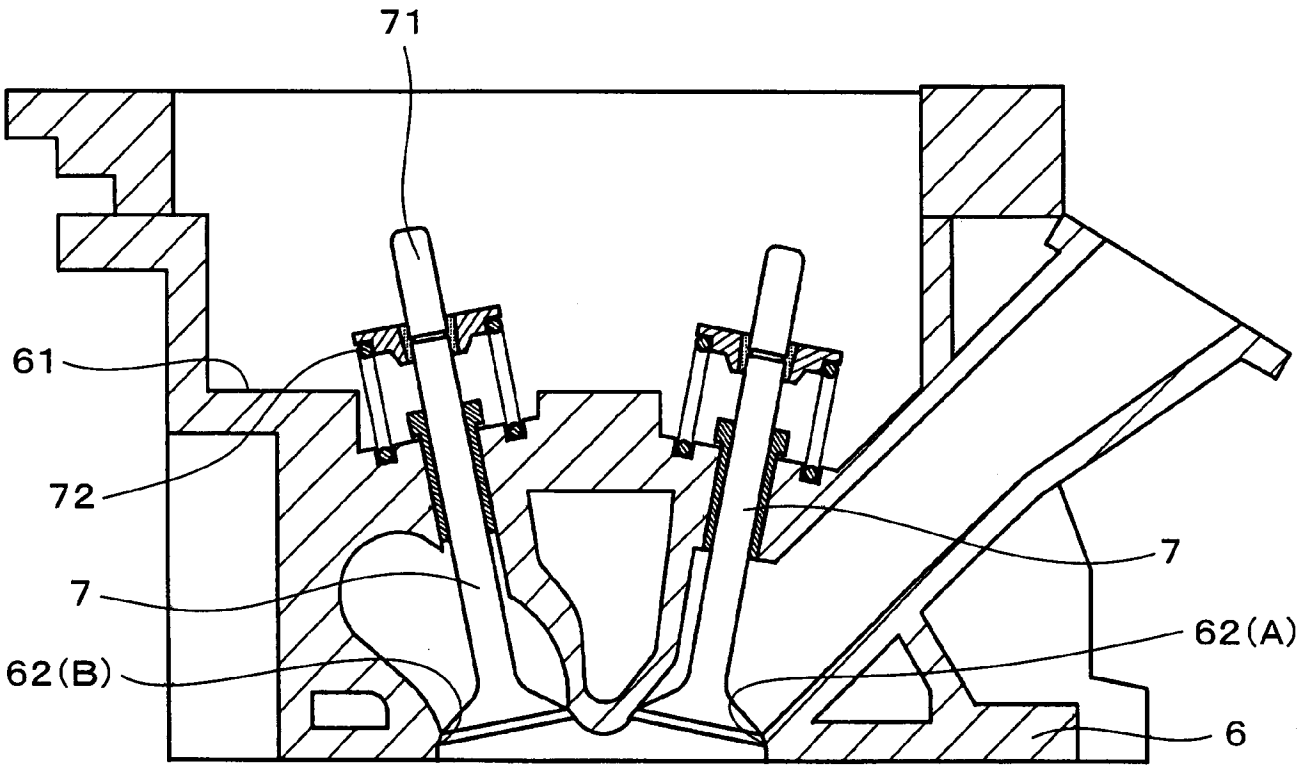
FIG. 3 is a sectional explanatory diagram showing a cylinder head in which the engine valve is disposed according to the first embodiment.

As shown in FIG. 2, the rocker arm installed module 1 of this embodiment is constructed by installing the cam shaft 3, the rocker arm 4 and the pivot 5 to the housing 2. Then, as shown in FIGS. 1, 3, by disposing the housing 2 in this installed condition in the cylinder head 6, the stem front end portion 71 of the engine valve 7 disposed slidably in the cylinder head 6 can be engaged with the rocker arm 4 in the housing 2. Consequently, a valve opening and closing mechanism of the engine can be formed.

As shown in FIG. 2, the rocker arm installed module 1 can be installed separately from the cylinder head 6 and can be carried individually. Further, the housing 2 is provided with the aforementioned drop-off preventing projection 21. When installing the cam shaft 3, the rocker arm 4 and the pivot 5 to the housing 2, the rocker arm 4 is disposed among the cam 31 of the cam shaft 3, the pivot 5 and the drop-off preventing projection 21. Consequently, the rocker arm 4 is supported from a lower position by the pivot 5 and the drop-off preventing projection 21, so that it is prevented from dropping off upward by the cam 31. Thus, the rocker arm installed module 1 can prevent the rocker arm 4 from dropping off of the housing 2.

Further, the rocker arm installed module 1 can be disposed in the cylinder head 6 in which the engine valve 7 is disposed slidably while preventing the rocker arm 4 from dropping off. Consequently, the rocker arm installed module 1 can be installed easily to the cylinder head 6.

The drop-off preventing projection 21 in the housing 2 is provided at a position lower than a rocking range X of the rocker arm 4 when it is actuated. Consequently, when the rocker arm 4 and the stem front end portion 71 of the engine valve 7 engage each other, the drop-off preventing projection 21 can be prevented from being an obstacle to the rocking motion of the rocker arm 4.

Thus, the rocker arm installed module 1 of this embodiment enables the cam shaft 3, the rocker arm 4 and the pivot 5 to be installed to the housing 2 while preventing the rocker arm 4 from being dropped off, as a module.

Second Embodiment

Figure 6:
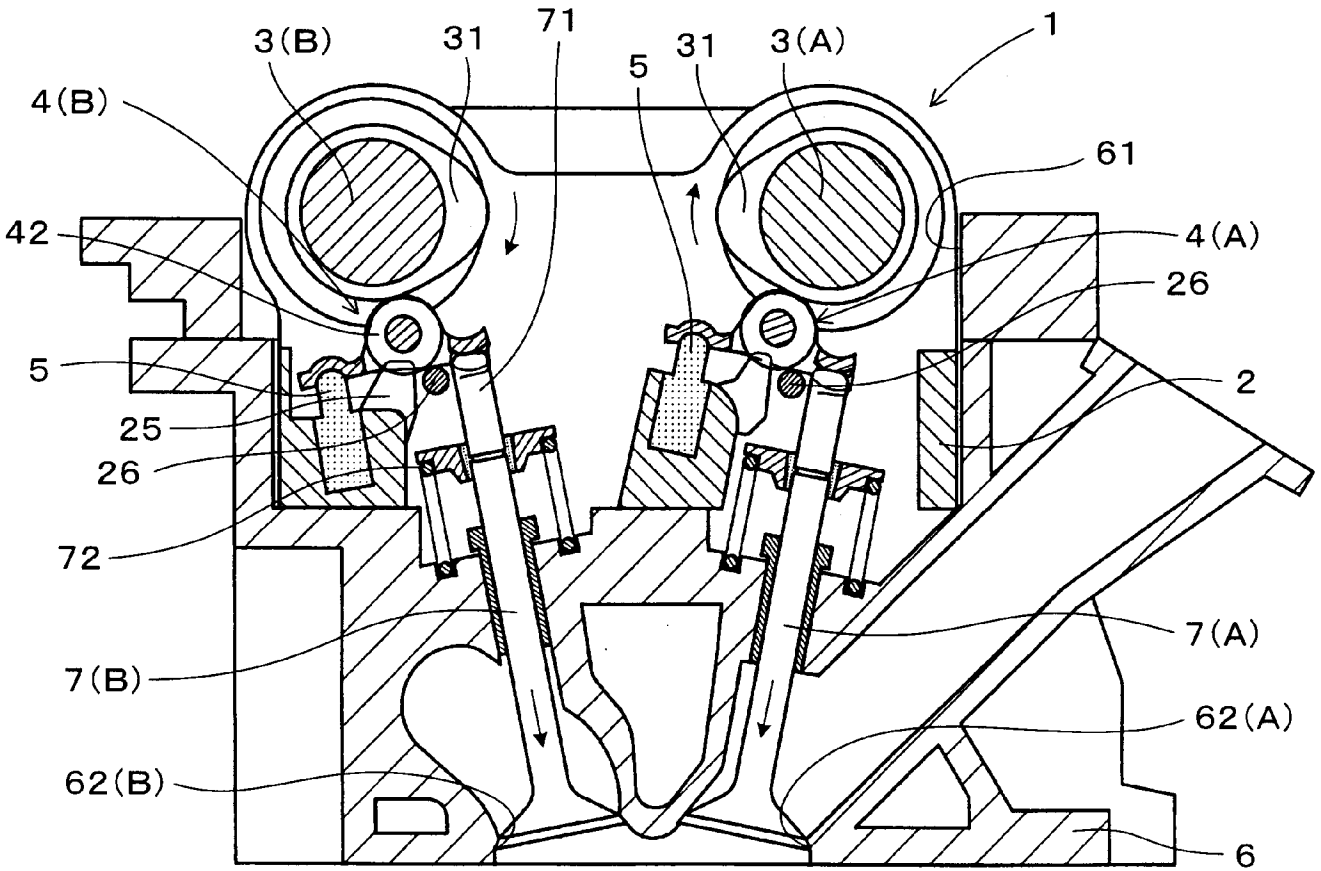
FIG. 6 is a sectional explanatory diagram showing a condition in which the rocker arm installed module is disposed within the concave portion of the cylinder head, according to the second embodiment.
Figure 7:
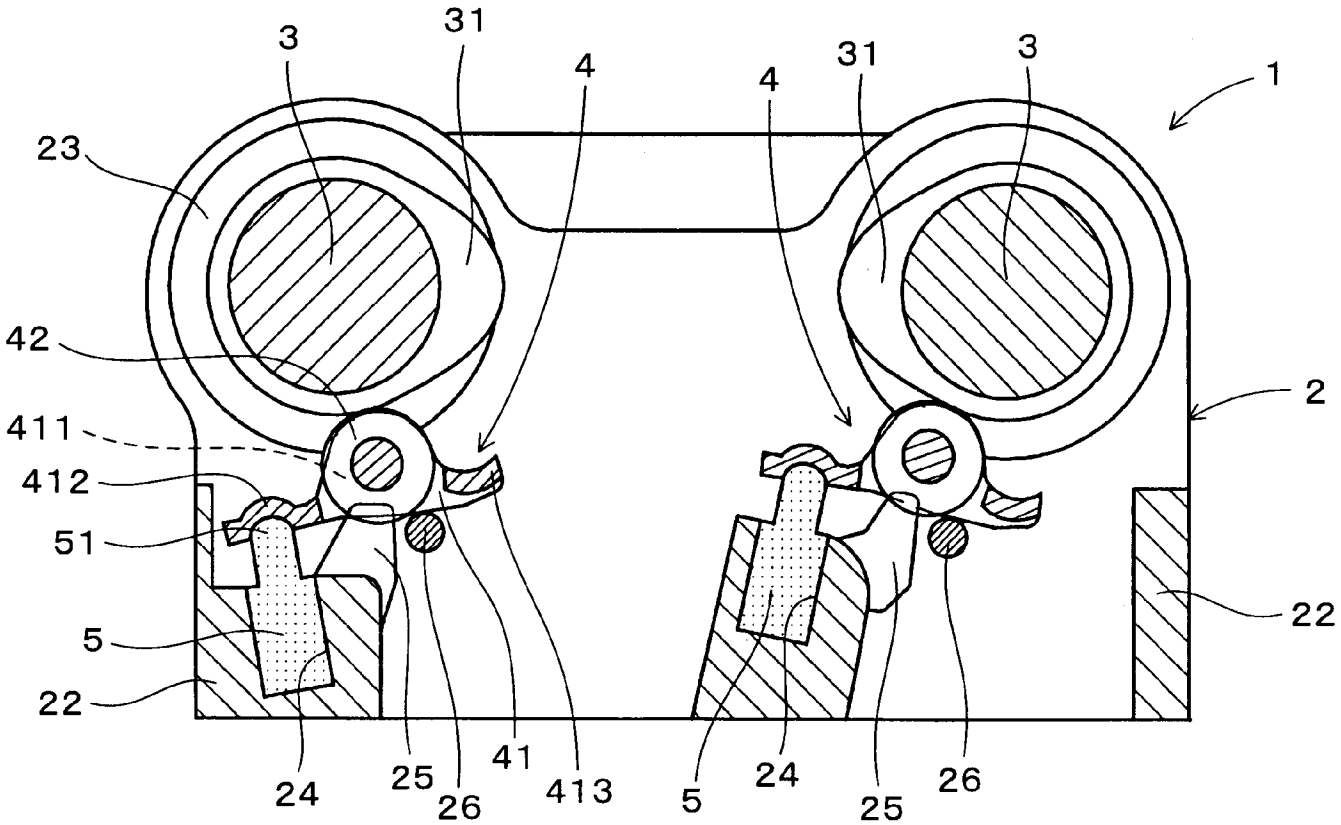
FIG. 7 is a sectional explanatory diagram showing the rocker arm installed module according to the second embodiment.
Figure 8:
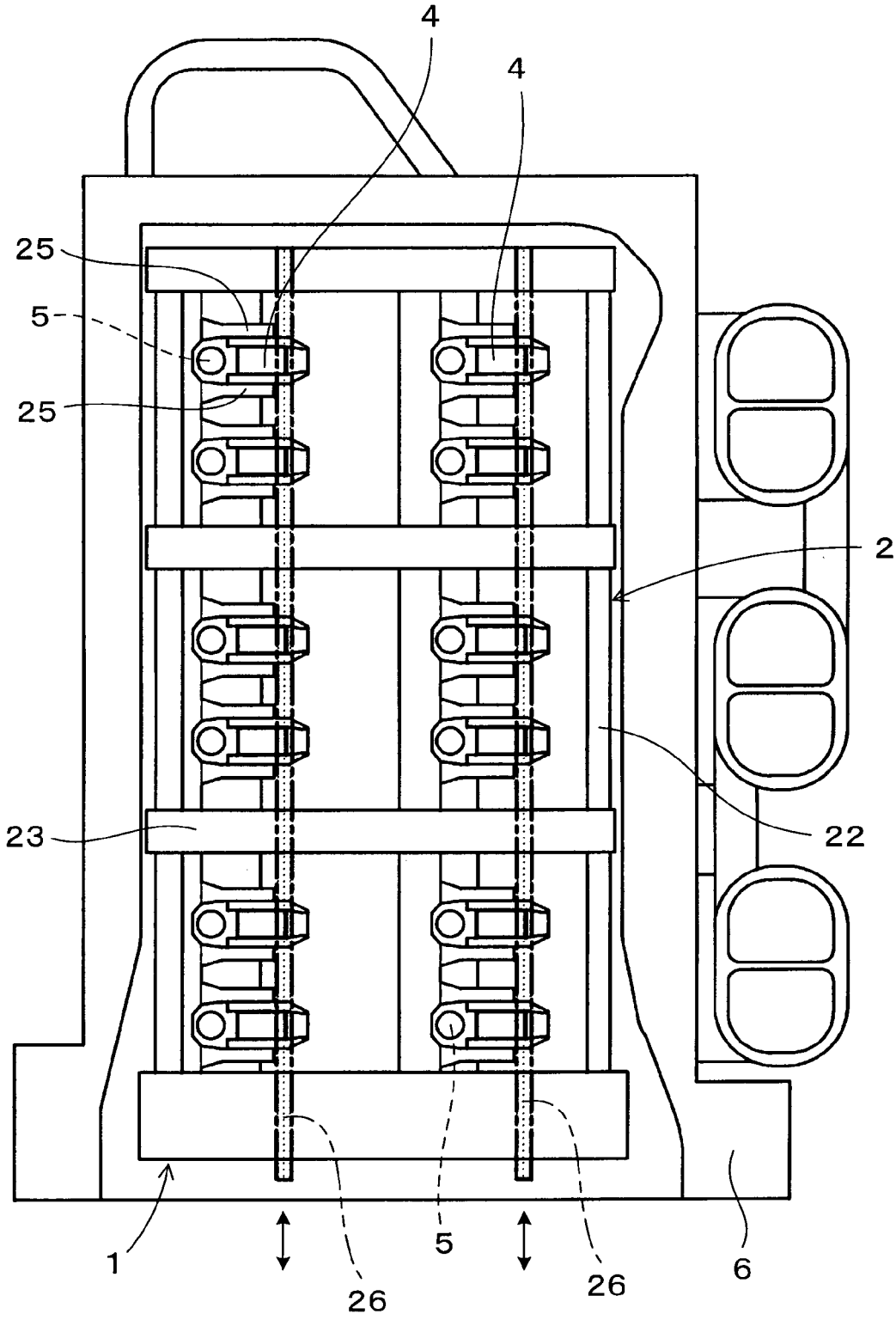
FIG. 8 is a plan explanatory diagram showing a condition in which the rocker arm installed module is disposed within the concave portion in the cylinder head, according to the second embodiment.

According to this embodiment, as shown in FIGS. 6-8, an inserted drop-off preventing pin 26 is provided in the housing 2 as an inserted drop-off preventing means which can be inserted or removed relative to the housing 2 instead of provision of the drop-off preventing projection 21 as the aforementioned drop-off preventing means.

The housing 2 of this embodiment is provided with the inserted drop-off preventing pin 26 for supporting the rocker arm 4 of which an end is disposed on the pivot 5 from dropping off within a rocking range when the rocker arm 4 is actuated.

As shown in FIG. 7, the rocker arm installed module 1 of this embodiment is constructed into a module by disposing the rocker arm 4 among the cam 31 of the cam shaft 3, the pivot 5 and the inserted drop-off preventing pin 26 in the housing 2 and, as shown in FIG. 6, is disposed in the cylinder head 6 in a state where the rocker arm 4 is prevented from dropping off. Further, the rocker arm installed module 1 of this embodiment is so constructed that the inserted drop-off preventing pin 26 is removed from the housing 2 after it is disposed in the cylinder head 6.

In this embodiment also, the housing 2 is so constructed that a plurality of the pivots 5 are fixed and a plurality of the rocker arms 4 are disposed corresponding to the quantity of the pivots 5. As shown in FIG. 8, the rocker arms 4 and the pivots 5 are disposed in parallel on the housing 2 along the axial direction of the cam shaft 3 corresponding to the quantity of the cams 31 provided on the cam shaft 3.

As shown in the same Figure, the inserted drop-off preventing pins 26 are provided in the housing 2 in parallel to the cam shaft 3, thereby preventing a plurality of the rocker arms 4 disposed in parallel to the cam shaft 3 from dropping off. In the housing 2 of this embodiment, the two inserted drop-off preventing pins 26 are provided such that they can be inserted or removed, corresponding to the suction side cam shaft 3A and the exhaust side cam shaft 3B.

In this embodiment, a plurality of the rocker arms 4 can be prevented from dropping off by each inserted drop-off preventing pin 26, whereby reducing the quantity of the inserted drop-off preventing pins 26.

The inserted drop-off preventing pins 26 in the housing 2 are provided within a rocking range when the rocker arm 4 is actuated and can be inserted into/removed from the housing 2. Then, the rocker arm installed module 1 is disposed in the cylinder head 6 and when the rocker arm 4 and the stem front end portion 71 of the engine valve 7 are engaged with each other, the inserted drop-off preventing pin 26 is removed from the housing 2. Consequently, the inserted drop-off preventing pin 26 can be prevented from being obstacle to the rocking motion of the rocker arm 4.

In this embodiment also, other structure is the same as the first embodiment and the same operation and effect as in the first embodiment can be obtained.

Obviously, numerous modifications and variations of the present invention are possible in light of the above teachings. It is therefore to be understood that, within the scope of the appended claims, the invention may be practiced otherwise than as specifically described here.

What is claimed is:

1. A rocker arm installed module comprising:

a housing disposed in a cylinder head in which engine valves are arranged slidably;

a cam shaft supported rotatably relative to the housing;

a rocker arm for opening and closing the engine valve by receiving a rotation of a cam provided on the cam shaft and rocking; and a pivot which is fixed to the housing and supports an end of the rocker arm slidably while forming a rocking support point of the rocker arm, wherein the housing includes a drop-off preventing means for supporting the rocker arm not to drop off from the pivot, and the drop-off preventing means is disposed at a lower position than a rocking range when the rocker arm is actuated, and the rocker arm is disposed among the cam of the cam shaft, the pivot and the drop-off preventing means in the housing to form a module, the module being configured to be disposed in the cylinder head while the rocker arm is prevented from dropping off.

2. The rocker arm installed module according to claim 1 wherein a plurality of the pivots are fixed and a plurality of the rocker arms are disposed corresponding to the quantity of the pivots in the housing, and the drop-off preventing means comprise a plurality of drop-off preventing projections formed in the housing corresponding to arrangement positions of a plurality of rocker arms.

3. A rocker arm installed module comprising:

a housing disposed in a cylinder head in which engine valves are arranged slidably;

a cam shaft supported rotatably relative to the housing;

a rocker arm for opening and closing the engine valve by receiving a rotation of a cam provided on the cam shaft and rocking; and a pivot which is fixed to the housing and support an end of the rocker arm slidably while forming a rocking support point of the rocker arm, wherein the housing includes an inserted drop-off preventing means for supporting the rocker arm not to drop off from the pivot, the inserted drop-off preventing means is disposed in a rocking range when the rocker arm is actuated, and the rocker arm is disposed among the cam of the cam shaft, the pivot and the inserted drop-off preventing means in the housing to form a module, the module being configured to be disposed in the cylinder head while the rocker arm is prevented from dropping off and after the module is disposed in the cylinder head, the inserted drop-off preventing means is removed from the housing.

4. The rocker arm installed module according to claim 3 wherein the cam shaft includes a plurality of the cams, a plurality of the rocker arms are disposed in parallel along the axial direction of the cam shaft corresponding to the quantity of the cams, and the inserted drop-off preventing means comprise an inserted drop-off preventing pin which is provided in the housing in parallel to the cam shaft and capable of preventing a plurality of the rocker arms from dropping off.

* * * * *